US010806320B1

(12) United States Patent
Welbourne

(10) Patent No.: US 10,806,320 B1
(45) Date of Patent: Oct. 20, 2020

(54) BASEBOARD-CLEANING IMPLEMENT

(71) Applicant: Rosabel Welbourne, Dallas, GA (US)

(72) Inventor: Rosabel Welbourne, Dallas, GA (US)

( * ) Notice: Subject to any disclaimer, the term of this patent is extended or adjusted under 35 U.S.C. 154(b) by 106 days.

(21) Appl. No.: 16/247,662

(22) Filed: Jan. 15, 2019

(51) Int. Cl.

| | |
|---|---|
| ***A46B 5/00*** | (2006.01) |
| ***A46B 13/04*** | (2006.01) |
| ***A47L 11/38*** | (2006.01) |
| ***A47L 11/40*** | (2006.01) |
| ***A46B 11/00*** | (2006.01) |
| ***A46B 9/00*** | (2006.01) |
| ***B08B 1/00*** | (2006.01) |
| ***B08B 1/04*** | (2006.01) |
| ***B08B 3/04*** | (2006.01) |
| ***A46B 7/04*** | (2006.01) |
| ***A46B 13/00*** | (2006.01) |

(52) U.S. Cl.
CPC ..... *A47L 11/38* (2013.01); *A46B 5/0095* (2013.01); *A46B 7/042* (2013.01); *A46B 9/005* (2013.01); *A46B 11/002* (2013.01); *A46B 11/0062* (2013.01); *A46B 13/008* (2013.01); *A46B 13/04* (2013.01); *A47L 11/4005* (2013.01); *A47L 11/4038* (2013.01); *A47L 11/4083* (2013.01); *A47L 11/4088* (2013.01); *B08B 1/002* (2013.01); *B08B 1/04* (2013.01); *B08B 3/04* (2013.01); *A46B 2200/3033* (2013.01); *A46B 2200/3073* (2013.01); *A46B 2200/3086* (2013.01)

(58) Field of Classification Search
CPC ..... A46B 5/0095; A46B 7/04; A46B 7/042; A46B 11/0062; A46B 13/008; A46B 13/04; A47L 11/38; A47L 11/4038; A47L 11/4083
See application file for complete search history.

(56) References Cited

U.S. PATENT DOCUMENTS

| | | | | |
|---|---|---|---|---|
| 3,270,361 | A | 9/1966 | Okun | |
| 4,299,004 | A | 11/1981 | Lancaster | |
| 4,691,403 | A | 9/1987 | Scharf | |
| 5,371,912 | A | 12/1994 | Hall | |
| D498,027 | S | 11/2004 | Alsruh | |
| 8,109,685 | B1 * | 2/2012 | Vito | A46B 5/0095 401/188 R |
| 8,402,588 | B2 | 3/2013 | Harris | |

(Continued)

FOREIGN PATENT DOCUMENTS

EP 2467049 5/2015

*Primary Examiner* — Randall E Chin
(74) *Attorney, Agent, or Firm* — Kyle A. Fletcher, Esq.

(57) ABSTRACT

The baseboard-cleaning implement is a handheld device. The baseboard-cleaning implement is a hand tool. The baseboard-cleaning implement is configured for use in cleaning a baseboard. The baseboard-cleaning implement is a cleaning brush. The baseboard-cleaning implement is configured for use with a liquid soap. The baseboard-cleaning implement includes a handle, a plurality of interchangeable brushes, a fastener, and a control circuit. The fastener removably attaches any brush selected from the plurality of interchangeable brushes to the handle. The handle contains the control circuit. The control circuit pumps the liquid soap from the handle into the selected brush. The control circuit rotates any brush selected from the plurality of interchangeable brushes. The direction of rotation of the selected brush is selectable.

16 Claims, 5 Drawing Sheets

(56) References Cited

U.S. PATENT DOCUMENTS

| | | | | |
|---|---|---|---|---|
| 9,462,923 | B2 | 10/2016 | Powell | |
| 9,586,561 | B1 * | 3/2017 | Nganga | A46B 13/008 |
| 10,251,471 | B1 * | 4/2019 | Sanderson | A46B 11/0017 |
| 2003/0213078 | A1 * | 11/2003 | Kristofek | B08B 1/04 15/97.1 |
| 2006/0218732 | A1 * | 10/2006 | Standish | A46B 11/066 15/24 |
| 2008/0022484 | A1 * | 1/2008 | Caruso | B25F 5/02 15/344 |
| 2008/0230246 | A1 * | 9/2008 | Dollar-Wright | A46B 13/023 173/29 |

* cited by examiner

BASEBOARD-CLEANING IMPLEMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including machines for cleaning floors and walls, more specifically, a disk-shaped surface treating tool not otherwise provided for in groups A47L11/02 thru A47L11/38. (A47L11/4038)

SUMMARY OF INVENTION

The baseboard-cleaning implement is a handheld device. The baseboard-cleaning implement is a hand tool. The baseboard-cleaning implement is configured for use in cleaning a baseboard. The baseboard-cleaning implement is configured for use in cleaning the brink between a first wall and a second wall. The baseboard-cleaning implement is a cleaning brush. The baseboard-cleaning implement is configured for use with a liquid soap. The baseboard-cleaning implement comprises a handle, a plurality of interchangeable brushes, a fastener, and a control circuit. The fastener removably attaches any brush selected from the plurality of interchangeable brushes to the handle. The handle contains the control circuit. The control circuit pumps the liquid soap from the handle into the selected brush. The control circuit rotates any brush selected from the plurality of interchangeable brushes. The direction of rotation of the selected brush is selectable.

These together with additional objects, features and advantages of the baseboard-cleaning implement will be readily apparent to those of ordinary skill in the art upon reading the following detailed description of the presently preferred, but nonetheless illustrative, embodiments when taken in conjunction with the accompanying drawings.

In this respect, before explaining the current embodiments of the baseboard-cleaning implement in detail, it is to be understood that the baseboard-cleaning implement is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the baseboard-cleaning implement.

It is therefore important that the claims be regarded as including such equivalent construction insofar as they do not depart from the spirit and scope of the baseboard-cleaning implement. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
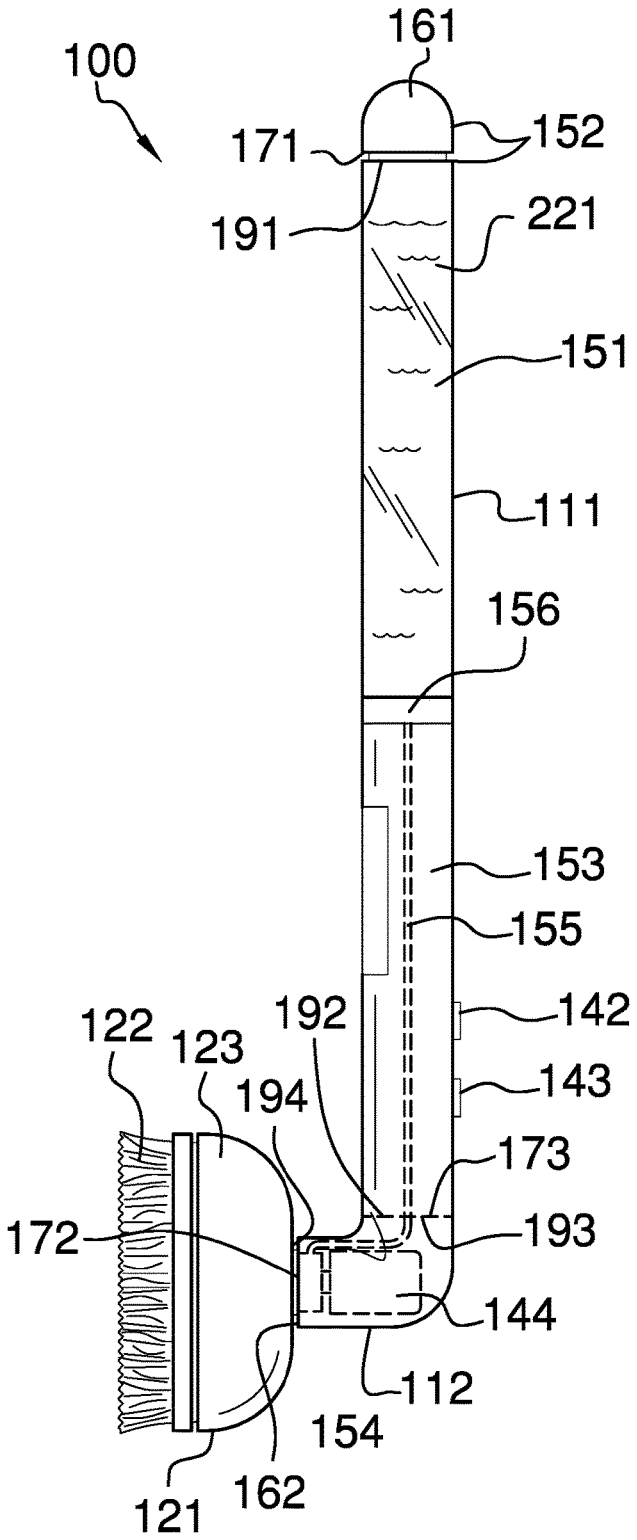
FIG. 1 is a side view of an embodiment of the disclosure.
Figure 2:
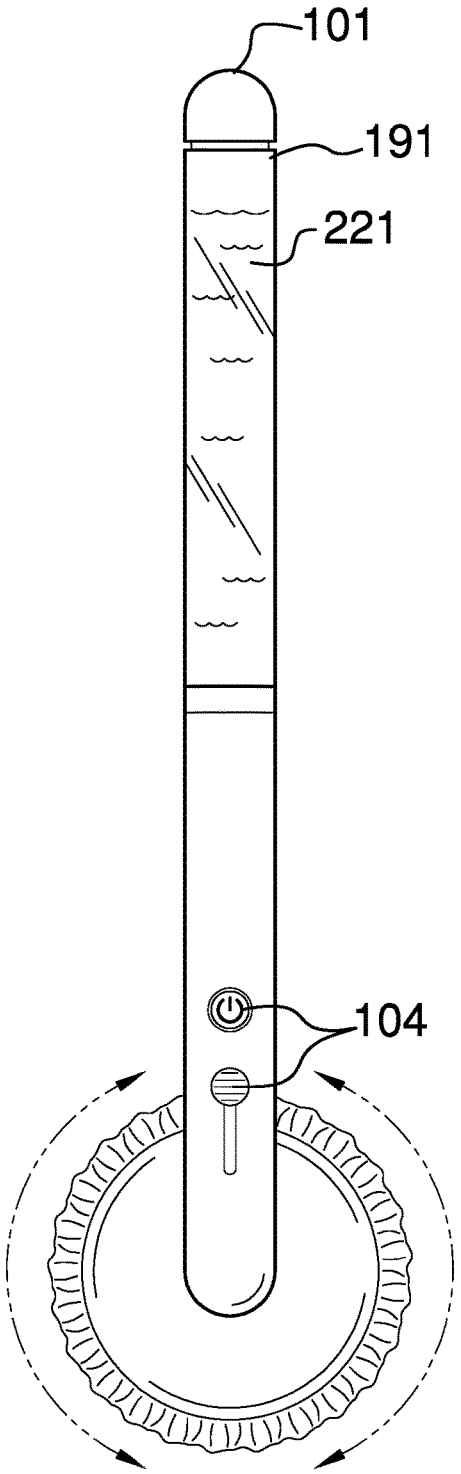
FIG. 2 is a front view of an embodiment of the disclosure.
Figure 3:
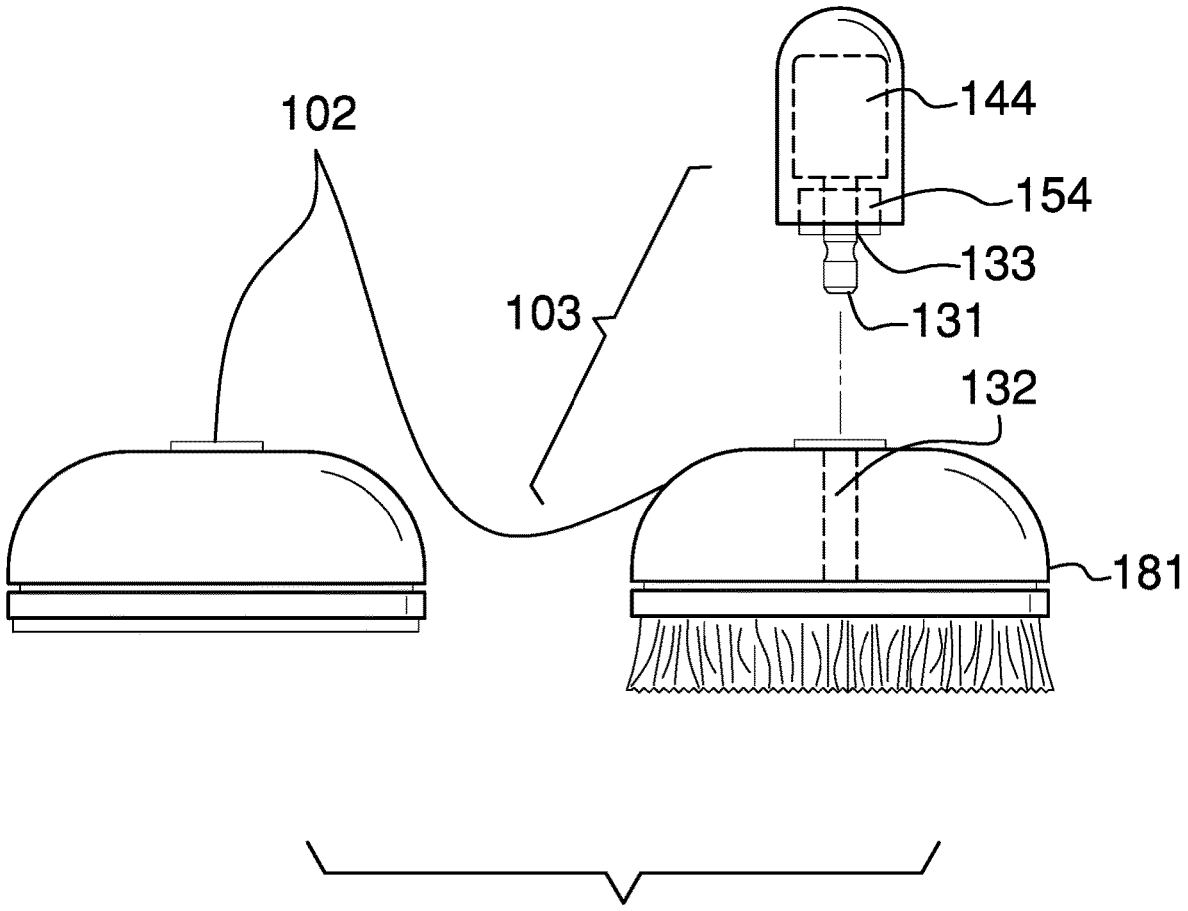
FIG. 3 is an end view of an embodiment of the disclosure.
Figure 4:
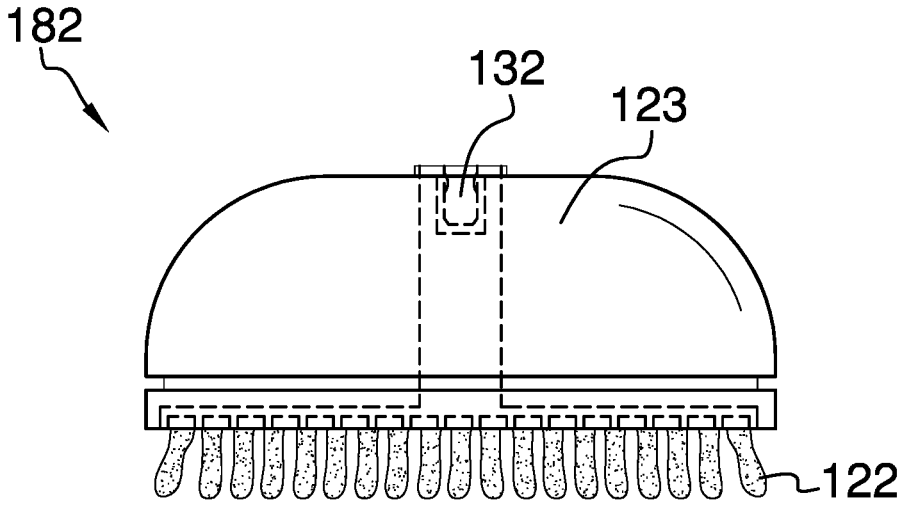
FIG. 4 is an end view of an alternative embodiment of the disclosure.
Figure 5:
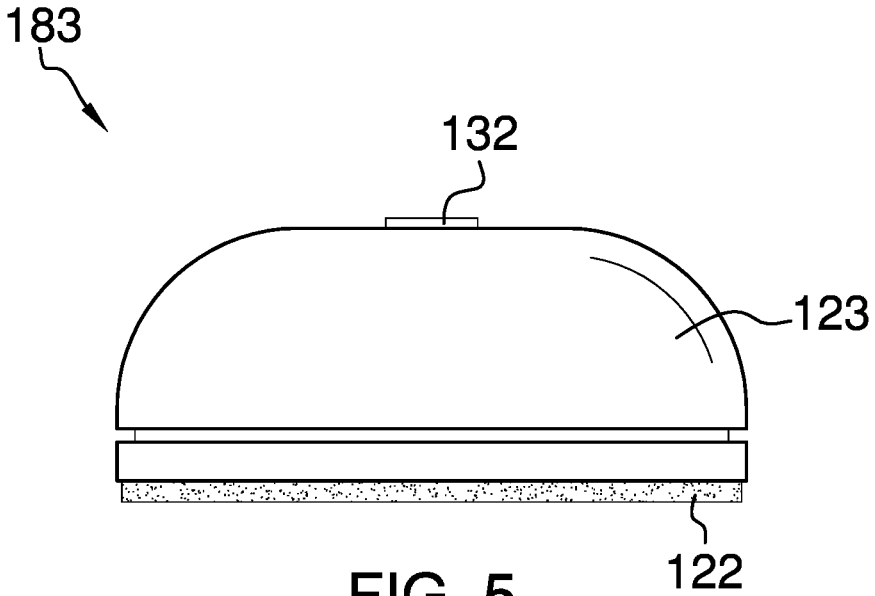
FIG. 5 is an end view of an alternative embodiment of the disclosure.
Figure 6:
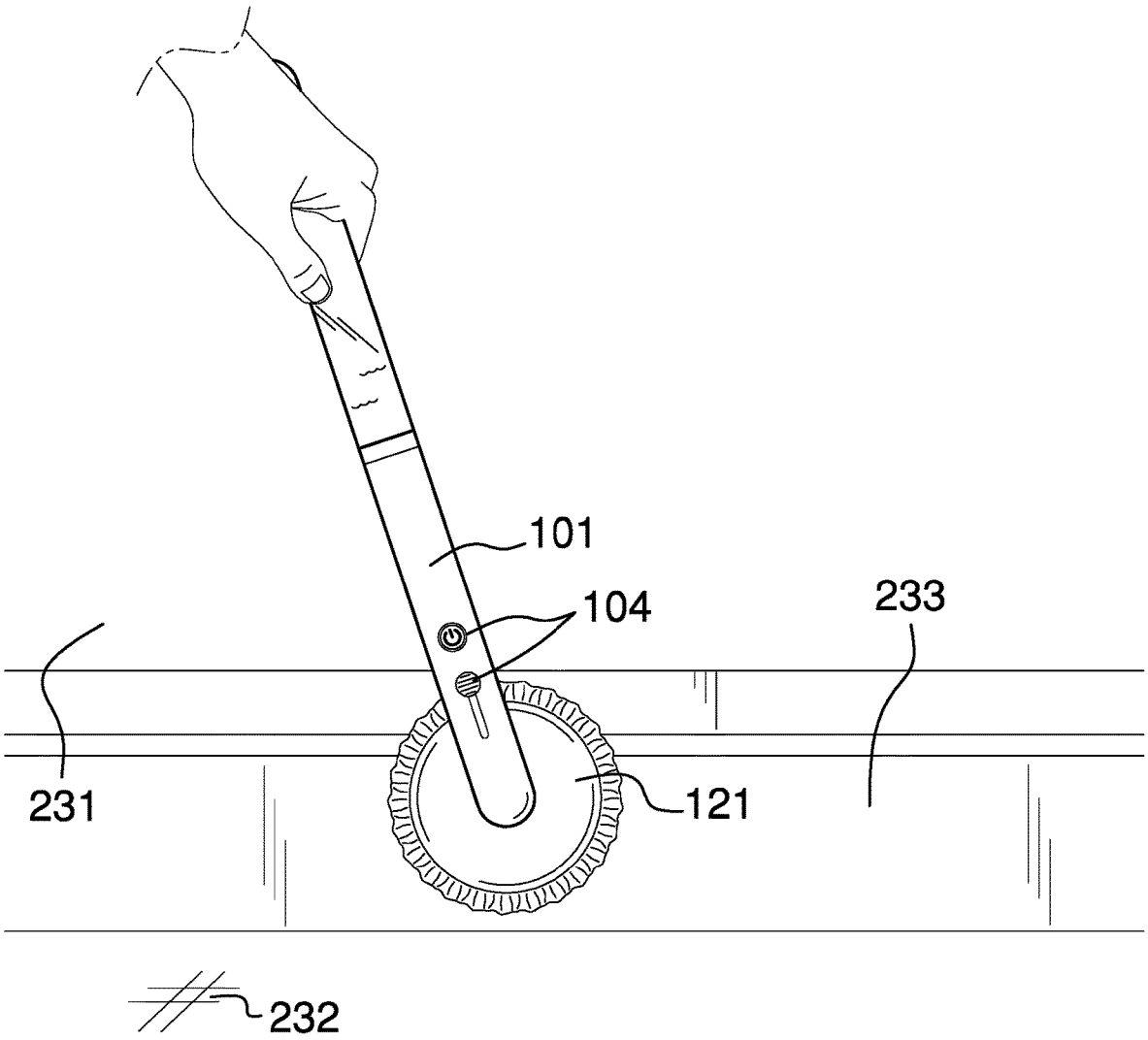
FIG. 6 is an in-use view of an embodiment of the disclosure.
Figure 7:
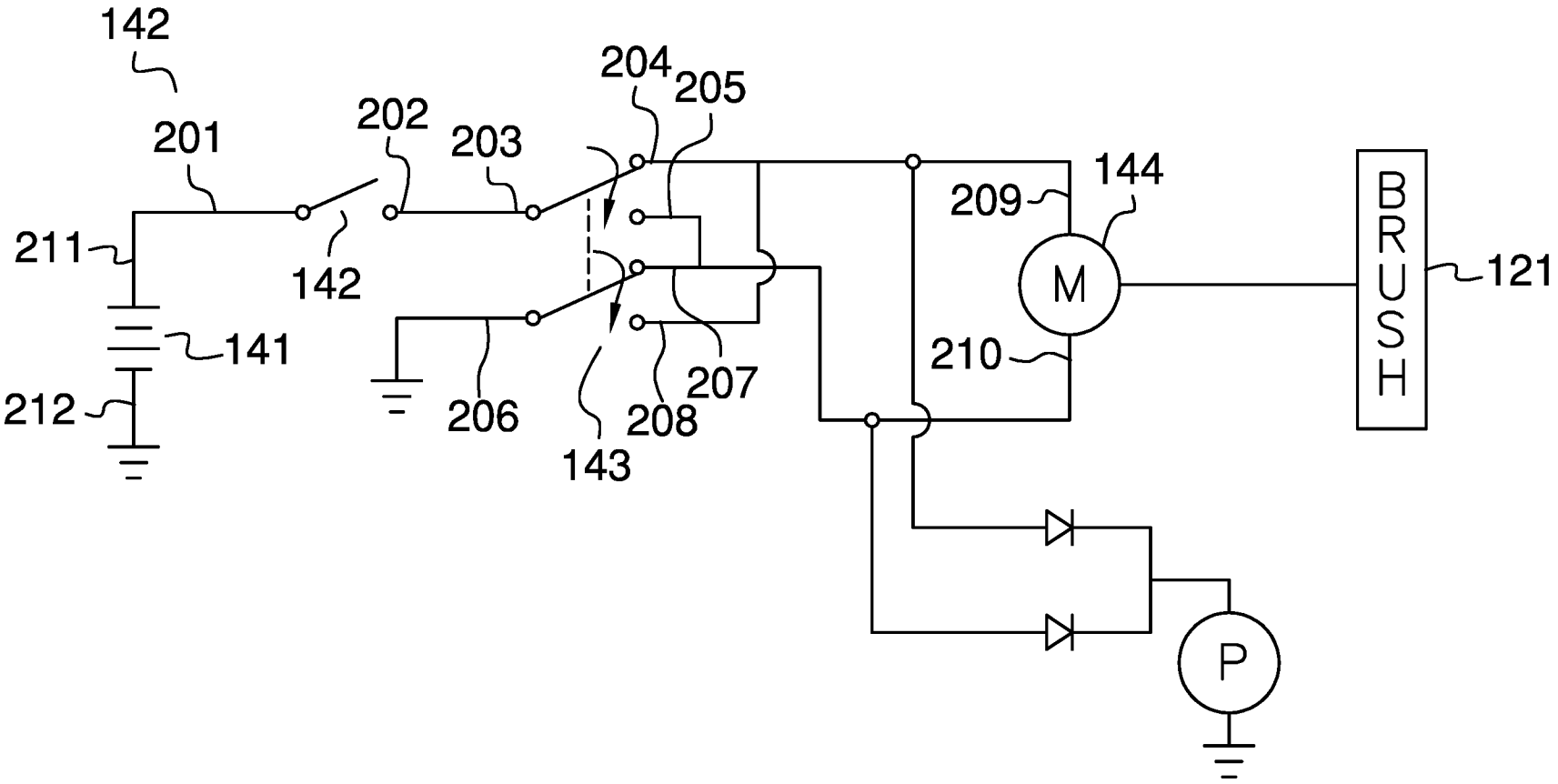
FIG. 7 is a schematic view of an embodiment of the disclosure.

Detailed reference will now be made to one or more potential embodiments of the disclosure, which are illustrated in FIGS. 1 through 7.

The baseboard-cleaning implement 100 (hereinafter invention) is a handheld device. The invention 100 is a hand tool. The invention 100 is configured for use in cleaning a baseboard 233 near a floor 232. The invention 100 is configured for use in cleaning the brink between a first wall 231 and a second wall 231. The invention 100 is a cleaning brush. The invention 100 is configured for use with a liquid soap 221. The invention 100 comprises a handle 101, a plurality of interchangeable brushes 102, a brush fastener 103, and a control circuit 104. The brush fastener 103 removably attaches any individual brush 121 selected from the plurality of interchangeable brushes 102 to the handle 101. The handle 101 contains the control circuit 104. The control circuit 104 pumps the liquid soap 221 from the handle 101 into the selected brush. The control circuit 104 rotates any individual brush 121 selected from the plurality of interchangeable brushes 102. The direction of rotation of the individual brush 121 is selectable.

The handle 101 is a prism-shaped structure. The handle 101 forms a grip used to manipulate the invention 100. The handle 101 contains the control circuit 104. The handle 101 further contains the liquid soap 221. The handle 101 comprises a center capped tube 111 and a 90-degree elbow 112. The center capped tube 111 is further defined with a first end 191 and a second end 192. The 90-degree elbow 112 is further defined with a third end 193 and a fourth end 194.

The center capped tube 111 is a hollow prism-shaped structure. The center capped tube 111 is bifurcated into two storage chambers. Each of the bifurcated storage chambers of the center capped tube 111 contains an element of the invention selected from the group consisting of the control circuit 104 and the liquid soap 221. The bifurcated storage chambers of the center capped tube 111 are fluidically isolated such that the liquid soap 221 will not leak into the control circuit 104. The center capped tube 111 comprises a reservoir tube 151, an equipment tube 153, and a center barrier 156. The first end 191 is the open end of the reservoir tube 151 of the center capped tube 111. The second end 192 is the open end of the equipment tube 153 of the center capped tube 111.

The center barrier 156 is a fluid impermeable barrier segregates the reservoir tube 151 and the equipment tube 153.

The reservoir tube 151 is a capped tube structure that forms one of the bifurcated chambers of the center capped tube 111. The reservoir tube 151 stores the liquid soap 221 until it is transported to the pump 154. The reservoir tube 151 further comprises a lid 152. The lid 152 is a mechanical structure that encloses the open end of the reservoir tube 151. The lid 152 further comprises a first capped tube 161 and a first threaded connection 171.

The first capped tube 161 is the physical structure that encloses the open end of the reservoir tube 151 that is distal from the equipment tube 153. The first threaded connection 171 attaches the first capped tube 161 to the reservoir tube 151.

The equipment tube 153 is a capped tube structure that forms one of the bifurcated chambers of the center capped tube 111. The equipment tube 153 contains the control circuit 104. The equipment tube 153 contains the pump 154 and the pump feed 155. The equipment tube 153 transports the liquid soap 221 from the reservoir tube 151 into the pump 154. The equipment tube 153 further comprises a pump 154 and a pump feed 155.

The pump 154 is a mechanical device that generates a pressure differential used for transporting the liquid soap 221 from reservoir tube 151 into the selected individual brush 121 through the rotary union 133. The pump 154 is an electrically powered device. The pump 154 feed 155 is a hose. The pump 154 feed 155 forms a fluidic connection between the reservoir tube 151 and the pump 154. The pump 154 feed 155 transports the liquid soap 221 from the reservoir tube 151 to the pump 154.

The 90-degree elbow 112 is a plumbing fitting. The 90-degree elbow 112 is a mechanical structure that attaches the selected individual brush 121 to the center capped tube 111 such that the face of the working element of the selected individual brush 121 is perpendicular to the center axis of the individual brush 121 that forms the working element of the plurality of interchangeable brushes 102. The 90-degree elbow 112 further comprises a second capped tube 162, a second threaded connection 172, and a third threaded connection 173. The third end 193 is the end of the 90-degree elbow 112 that attaches to the equipment tube 153. The fourth end 194 is the end of the 90-degree elbow 112 that is distal from the equipment tube 153.

The second capped tube 162 is the physical structure that encloses the open end of the equipment tube 153 that is distal from the reservoir tube 151. The second threaded connection 172 attaches the second capped tube 162 to the equipment tube 153. The second capped tube 162 encloses the 90-degree elbow 112.

The third threaded connection 173 is a thread connection used to assemble the handle 101. Specifically, the third threaded connection 173 attaches the 90-degree elbow 112 to the open end of the center capped tube 111.

Each of the plurality of interchangeable brushes 102 forms the working element of the invention 100. Each of the plurality of interchangeable brushes 102 removably attaches to the handle 101. Each of the plurality of interchangeable brushes 102 is a rotating structure. Each of the plurality of interchangeable brushes 102 cleans a surface selected from the group consisting of a baseboard 233 and a brink formed at the intersection of a first wall 231 and a second wall 231. Any first brush 181 selected from the plurality of interchangeable brushes 102 interchanges with any second brush 182 selected from the plurality of interchangeable brushes 102. The plurality of interchangeable brushes 102 comprises a collection of individual brushes 121.

The rotation of any individual brush 121 cleans the surface selected from the group consisting of a baseboard 233 and a brink formed at the intersection of a first wall 231 and a second wall 231. Each individual brush 121 comprises a cleaning surface 122 and a base 123.

The cleaning surface 122 is a cleansing structure placed in contact with a surface selected from the group consisting of a baseboard 233 and a brink formed at the intersection of a first wall 231 and a second wall 232. The rotation of the base 123 rotates the cleaning surface 122 during the cleaning process. The rotation of the cleaning surface 122 physically cleans the selected surface. In the first potential embodiment of the disclosure, the cleaning surface 122 is selected from the group consisting of a plurality of bristles, a microfiber head, and a polishing head.

The base 123 is a disk-shaped structure. The base 123 attaches the cleaning surface 122 to the tenon 131 of the fastener 103. The base 123 is a rigid structure. The cleaning surface 122 attaches to the base 123 to form a composite prism.

In the first potential embodiment of the disclosure, the plurality of interchangeable brushes 102 comprises a first brush 181, a second brush 182, and a third brush 183. The first brush 181 is a brush selected from the plurality of interchangeable brushes 102. The first brush 181 comprises a plurality of bristles. The second brush 182 is a brush selected from the plurality of interchangeable brushes 102. The second brush 182 comprises a microfiber textile sheeting. The third brush 183 is a brush selected from the plurality of interchangeable brushes 102. The third brush 183 is an elastomeric polishing surface. By elastomeric polishing surface is meant a smooth surface formed from an elastomeric material.

The fastener 103 is a fastening device that attaches any selected individual brush 121 from the plurality of interchangeable brushes 102 to the handle 101. The fastener 103 attaches the selected individual brush 121 to the handle 101 such that the selected individual brush 121 rotates around its center axis. The fastener 103 attaches the selected individual brush 121 to the handle 101 such that the liquid soap 221 can be pumped through the fastener 103 into the selected individual brush 121. The fastener 103 comprises a tenon 131, a mortise 132, and a rotary union 133.

The tenon 131 is a prism-shaped structure that attaches to the closed end of the second capped tube 162. The tenon 131 attaches to the electric motor 144 of the control circuit 104 such that the electric motor 144 will rotate the tenon 131. The rotation of the tenon 131 will rotate the individual brush 121 attached to the handle 101. The tenon 131 is a hollow structure such that the liquid soap 221 pumped into the individual brush 121 will flow through the tenon 131. The tenon 131 inserts into the mortise 132.

The mortise 132 is a cavity that is formed in the base 123 of the individual brush 121. The mortise 132 is geometrically similar to the tenon 131. The span of the length of the perimeter of the mortise 132 is greater than the span of the length of the perimeter of the tenon 131 such that the tenon 131 will insert into the mortise 132. The mortise 132 aligns with the center axis of the base 123 such that the rotation of the tenon 131 will rotate the base 123 around an axis of rotation aligned with the center axis of the base 123. The tenon 131 secures itself to the mortise 132 such that the rotation of the tenon 131 has a load transfer path that allows for the rotation base 123 of the individual brush 121.

The rotary union 133 is a bearing structure. The tenon 131 attaches to the rotary union 133 such that the rotation of the tenon 131 by the electric motor 144 is isolated from the second capped tube 162 of the 90-degree elbow 112 of the handle 101. The rotary union 133 further provides a fluid path for the liquid soap 221 to pass into the tenon 131 for transport to the cleaning surface 122 of the individual brush 121.

The design and use of a tenon 131, a mortise 132, and a rotary union 133 are well-known and documented in the mechanical arts.

The control circuit 104 is an electrical circuit. The control circuit 104 rotates the individual brush 121 such that the direction of rotation of the individual brush 121 is selectable and reversible. The control circuit 104 provides the power that pumps the liquid soap 221 from the handle 101 into the selected individual brush 121 through the fastener 103. The control circuit 104 comprises a battery 141, a master switch 142, a DPDT switch 143, and an electric motor 144. The battery 141 is further defined with a positive terminal 211 and a negative terminal 212. The master switch 142 is further defined with a first lead 201 and a second lead 202. The DPDT switch 143 is further defined with a third lead 203, a fourth lead 204, a fifth lead 205, a sixth lead 206, a seventh lead 207, and an eighth lead 208. The electric motor 144 is further defined with a ninth lead 209 and a tenth lead 210.

The battery 141 is a commercially available electrochemical device. The battery 141 provides the electrical energy required to operate the control circuit 104.

The master switch 142 is a single throw single pole electrical switch. The master switch 142 controls the flow of electricity from the battery 141 into the DPDT switch 143.

The DPDT switch 143 is a double pole double throw electric switch. The DPDT switch 143 forms a set of electrical connections selected from the group consisting of: a) a first electrical setting that electrically connects the third lead 203 to the fourth lead 204 while simultaneously connecting the sixth lead 206 to the seventh lead 207; and, 2) b) a second electrical setting that electrically connects the third lead 203 to the eleventh lead 241 while simultaneously connecting the sixth lead 206 to the fourteenth lead 244. In the first electrical setting, power is routed to the electric motor 144 such that the selected individual brush 121 rotates in a first direction. In the second electrical setting, power is routed to the electric motor 144 such that the selected individual brush 121 rotates in a second direction that is the reverse of the first direction. The DPDT switch 143 is also configured to provide electrical power to the pump 154.

The poles and throws of the master switch 142 and the DPDT switch 143 are defined in greater detail elsewhere in this disclosure.

The electric motor 144 is an electrically powered motor. The electric motor 144 rotates the tenon 131 such that the selected individual brush 121 is rotated. The direction of the rotation of electric motor 144 is controlled by the polarity of the voltage placed across the electric motor 144. The polarity of the voltage placed across the electric motor 144 is controlled by the DPDT switch 143.

This paragraph described the assembly of the handle 101. The first threaded connection 171 attaches the first end 191 of the center capped tube 111 to the first capped tube 161. The second threaded connection 172 attaches the fourth end 194 of the 90-degree elbow 112 to the second capped tube 162. The third threaded connection 173 attaches the third end 193 of the 90-degree elbow 112 to the second end 192 of the center capped tube 111.

The following two paragraphs describe the assembly of the control circuit 104.

The positive terminal 211 of the battery 141 electrically connects to the first lead 201 of the master switch 142. The second lead 202 of the master switch 142 electrically connects to the third lead 203 of the DPDT switch 143.

The fourth lead 204 of the DPDT switch 143 electrically connects to the ninth lead 209 of the electric motor 144. The fourth lead 204 of the DPDT switch 143 electrically connects to the eighth lead 208 of the DPDT switch 143. The fifth lead 205 of the DPDT switch 143 electrically connects to the tenth lead 210 of the electric motor 144. The fifth lead 205 of the DPDT switch 143 electrically connects to the seventh lead 207 of the DPDT switch 143. The seventh lead 207 of the DPDT switch 143 electrically connects to the tenth lead 210 of the electric motor 144. The eighth lead 208 of the DPDT switch 143 electrically connects to the ninth lead 209 of the electric motor 144. The sixth lead 206 of the DPDT switch 143 electrically connects to the negative terminal 212 of the battery 141.

The following definitions were used in this disclosure:

90-Degree Elbow: As used in this disclosure, a 90-degree elbow is a two-aperture fitting that attaches a first pipe to a second pipe such that the center axis of the first pipe is perpendicular to the center axis of the second pipe.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Baseboard: As used in this disclosure, a baseboard refers to a plate attached to the wall of a chamber at the brink formed between the wall and the chamber. In a common but informal usage, a baseboard can also refer to a region of a wall that is proximal to the brink formed between the wall and the chamber.

Battery: As used in this disclosure, a battery is a chemical device consisting of one or more cells, in which chemical energy is converted into electricity and used as a source of power. Batteries are commonly defined with a positive terminal and a negative terminal.

Bearing: As used in this disclosure, a bearing is a mechanical device that: 1) guides and limits the motion of a moving component relative to a fixed component; and, 2)

reduces the friction between the moving component and the fixed component. The use of bearings is well known and documented in the mechanical arts.

Brink: As used in this disclosure, a brink refers to the edge or line formed by the intersection of a first plane or surface and a second plane or surface wherein a cant exists between the first plane or surface and the second plane or surface.

Brush: As used in this disclosure, a brush is a device comprising a plurality of bristles set into a handle or a base that is used for grooming, sweeping, smoothing, scrubbing, or painting.

Cap: As used in this disclosure, a cap is a protective cover that encloses a space or opening.

Capped Tube: As used in this disclosure, a capped tube is a tube with one closed end and one open end.

Carboxylic Acid: As used in this disclosure, a carboxylic acid is an organic molecule that further comprises the carboxyl functional group.

Carboxyl Functional Group: As used in this disclosure, the carboxyl functional group is a functional group with the chemical formula —COOH.

Cavity: As used in this disclosure, a cavity is an empty space or negative space that is formed within an object. See Saucer Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center Capped Tube: As used in this disclosure, a center capped tube is a tube with a first open end, a second open end, and a barrier that is fabricated within the tube. The barrier prevents the flow of liquid or gas from the first open end of the tube through to the second open end of the tube. A center capped tube can be thought of as two capped tubes with a shared closed end.

Chamber: As used in this disclosure, a chamber is an enclosed space within a building.

Channel: As used in this disclosure, a channel is a tubular passage through which an object or fluid is passed through.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Denier: As used in this disclosure, the term denier is a unit of weight that can be used to describe the fineness of a nylon, polyester yarn, rayon, elastomeric or silk yarn. Denier is calculated as grams per 9000 meters.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that coaxially mounts in the stator. The magnetic interactions between the rotor and the stator physically cause the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Fastener: As used in this disclosure, a fastener is a device that is used to removably attach a first object to a second object.

Fatty Acid: As used in this disclosure, a fatty acid refers to a carboxylic acid with a continuous carbon chain of greater than three carbon atoms beyond the carboxyl functional group.

Fitting: As used in this disclosure, a fitting is a component that is attached to a first object. The fitting is used to forming a fluidic connection between the first object and a second object.

Floor: As used in this disclosure a floor refers to the inferior horizontal supporting surface of a chamber. An individual stands on a floor.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handheld: As used in this disclosure, when referring to an item or device, handheld means that the item or device is small and light enough: 1) to be operated while a person holds the item or device in their hands; and, 2) to be carried by hand over a distance.

Handle: As used in this disclosure, a handle is an object by which a tool, object, or door is held or manipulated with the hand.

Hand Tool: As used in this disclosure, a hand tool refers to a tool that is small and light enough to allow a person to hold the tool during use.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Maintained Switch: A used in this disclosure, a maintained switch is a switch that maintains the position that was set in the most recent switch actuation. A maintained switch works in an opposite manner to a momentary switch.

Microfiber Textile: As used in this disclosure, a microfiber textile is a textile that is formed from microfiber yarns.

Microfiber Yarn: As used in this disclosure, a yarn is said to be a microfiber yarn when the average number of filaments or fibers contained in a cross-section of the yarn is greater than the denier of the yarn. Stated differently, a microfiber yarn is a yarn made from fibers or filaments with an average fineness, as measured by denier, of less than one denier. Please note: This definition is similar to but differs from the definition of microfiber yarn that is generally accepted in the textile industry. This definition is preferred in this disclosure because of the relative simplicity of the definition and because the difference between the two definitions has little commercial or practical relevance.

Mortise: As used in this disclosure, a mortise is a prism-shaped negative spaced formed in an object that is designed to receive a geometrically similar object referred to as a tenon.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bounds an enclosed area on a plane or surface. The perimeter of a circle is commonly referred to as a circumference.

Plate: As used in this disclosure, a plate is a smooth, flat and semi-rigid or rigid structure that has at least one dimension that: a) is of uniform thickness; and b) that appears thin relative to the other dimensions of the object. Plates are often disks. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support. Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Reservoir: As used in this disclosure, a reservoir refers to a container or containment system that is configured to store a liquid.

Rigid Structure: As used in this disclosure, a rigid structure is a solid structure formed from an inelastic material that resists changes in shape. A rigid structure will permanently deform as it fails under a force.

Rotary Union: As used in this disclosure, a rotary union is a commercially available plumbing fitting that allows a fluid from a stationary source to be pumped into a rotating structure.

Rotation: As used in this disclosure, rotation refers to the cyclic movement of an object around a fixed point or fixed axis. The verb of rotation is to rotate.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions. In this disclosure, a metallic element is assumed to include the alkali metals and the alkali earth metals. Alternatively, and equivalently, a metallic element may be assumed to be any element on the periodic table that is to the left of the metalloids.

Screw: As used in this disclosure, to screw is a verb meaning: 1) to fasten or unfasten (unscrew) a threaded connection; or 2) to attach a helical structure to a solid structure.

Sheeting: As used in this disclosure, a sheeting is a material, such as a paper, textile, a plastic, or a metal foil, in the form of a thin flexible layer or layers.

Soap: As used in this disclosure, a soap is a cleansing chemical used in cleaning an object. A soap is generally formed from a mixture of one or more salts and one or more fatty acids.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tenon: As used in this disclosure, a tenon is a prism-shaped structure that fits into a mortise such that the tenon attaches to the mortise. The tenon is geometrically similar to the mortise.

Textile: As used in this disclosure, a textile is a material that is woven, knitted, braided or felted. Synonyms in common usage for this definition include fabric and cloth.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tool: As used in this disclosure, a tool is a device, an apparatus, or an instrument that is used to carry out an activity, operation, or procedure.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wall: As used in this disclosure, a wall is a vertical surface of a chamber.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A baseboard-cleaning implement comprising:

a handle, a plurality of interchangeable brushes, a brush fastener, and a control circuit;

wherein the brush fastener removably attaches any individual brush selected from the plurality of interchangeable brushes to the handle;

wherein the handle contains the control circuit;

wherein the baseboard-cleaning implement is a handheld device;

wherein the baseboard-cleaning implement is a hand tool;

wherein the baseboard-cleaning implement is configured for use in cleaning a baseboard and/or a corner of a wall;

wherein the baseboard-cleaning implement is configured for use in cleaning the brink between a first wall and a second wall;

wherein the control circuit pumps a liquid soap from the handle into the selected brush;

wherein the control circuit rotates any individual brush selected from the plurality of interchangeable brushes;

wherein the direction of rotation of the individual brush is selectable;

wherein each of the plurality of interchangeable brushes forms the working element of the baseboard-cleaning implement;

wherein each of the plurality of interchangeable brushes removably attaches to the handle;

wherein each of the plurality of interchangeable brushes is a rotating structure;

wherein each of the plurality of interchangeable brushes cleans a surface selected from the group consisting of a baseboard and a brink formed at the intersection of a first wall and a second wall;

wherein any initial brush selected from the plurality of interchangeable brushes interchanges with any subsequent brush selected from the plurality of interchangeable brushes;

wherein the plurality of interchangeable brushes comprises a collection of individual brushes;

wherein the rotation of any individual brush cleans the surface selected from the group consisting of a baseboard and a brink formed at the intersection of a first wall and a second wall;

wherein the control circuit is an electrical circuit;

wherein the control circuit rotates the individual brush such that the direction of rotation of the individual brush is selectable and reversible;

wherein the control circuit provides the power that pumps the liquid soap from the handle into the selected individual brush through the fastener;

wherein the handle comprises a center capped tube and a 90-degree elbow;

wherein the 90-degree elbow attaches to the center capped tube;

wherein the center capped tube is further defined with a first end and a second end;

wherein the 90-degree elbow is further defined with a third end and a fourth end.

2. The baseboard-cleaning implement according to claim 1 wherein the baseboard-cleaning implement is a cleaning brush;

wherein the baseboard-cleaning implement is configured for use with a liquid soap.

3. The baseboard-cleaning implement according to claim 2 wherein the handle is a prism-shaped structure;

wherein the handle forms a grip;

wherein the handle contains the liquid soap.

4. The baseboard-cleaning implement according to claim 3 wherein the fastener is a fastening device that attaches any selected individual brush from the plurality of interchangeable brushes to the handle;

wherein the fastener attaches the selected individual brush to the handle such that the selected individual brush rotates around its center axis;

wherein the fastener attaches the selected individual brush to the handle such that the liquid soap can be pumped through the fastener into the selected individual brush.

5. The baseboard-cleaning implement according to claim 4 wherein each individual brush comprises a cleaning surface and a base;

wherein the base attaches to the cleaning surface;

wherein the cleaning surface is a cleansing structure placed in contact with a surface selected from the group consisting of a baseboard and a brink formed at the intersection of a first wall and a second wall;

wherein the base rotates the cleaning surface during the cleaning process.

6. The baseboard-cleaning implement according to claim 5 wherein the control circuit comprises a battery, a master switch, a DPDT switch, and an electric motor;

wherein the battery, the master switch, the DPDT switch, and the electric motor are electrically interconnected;

wherein the electric motor is an electrically powered motor;

wherein the direction of the rotation of electric motor is controlled by the polarity of the voltage placed across the electric motor;

wherein the battery is further defined with a positive terminal and a negative terminal;

wherein the master switch is further defined with a first lead and a second lead;

wherein the DPDT switch is further defined with a third lead, a fourth lead, a fifth lead, a sixth lead, a seventh lead, and an eighth lead;

wherein the electric motor is further defined with a ninth lead and a tenth lead.

7. The baseboard-cleaning implement according to claim 6 wherein the center capped tube is a hollow prism-shaped structure;

wherein the center capped tube is bifurcated into two storage chambers;

wherein each of the bifurcated storage chambers of the center capped tube contains an element of the baseboard-cleaning implement selected from the group consisting of the control circuit and the liquid soap;

wherein the bifurcated storage chambers of the center capped tube are fluidically isolated such that the liquid soap will not leak into the control circuit;

wherein the 90-degree elbow is a mechanical structure that attaches the selected individual brush to the center capped tube such that the face of the working element of the selected individual brush is parallel to the center axis of the individual brush that forms the working element of the plurality of interchangeable brushes.

8. The baseboard-cleaning implement according to claim 7 wherein the center capped tube comprises a reservoir tube, an equipment tube, and a center barrier;

wherein the reservoir tube and the equipment tube are attached at the center barrier;

wherein the first end is the open end of the reservoir tube of the center capped tube;

wherein the second end is the open end of the equipment tube of the center capped tube;

wherein the reservoir tube is a capped tube structure that forms one of the bifurcated chambers of the center capped tube;

wherein the equipment tube is a capped tube structure that forms one of the bifurcated chambers of the center capped tube;

wherein the center barrier is a fluid impermeable barrier segregates the reservoir tube and the equipment tube;

wherein the reservoir tube stores the liquid soap until it is transported to the pump;

wherein the equipment tube contains the control circuit.

9. The baseboard-cleaning implement according to claim 8 wherein the equipment tube further comprises a pump and a pump feed;

wherein the equipment tube contains the pump and the pump feed;

wherein the pump is a mechanical device that generates a pressure differential used for transporting the liquid soap from reservoir tube into the selected individual brush through the rotary union;

wherein the pump is an electrically powered device;

wherein the pump feed is a hose;

wherein the pump feed forms a fluidic connection between the reservoir tube and the pump;

wherein the pump feed transports the cleaning surface from the reservoir tube to the pump.

10. The baseboard-cleaning implement according to claim 9 wherein the 90-degree elbow further comprises a second capped tube, a second threaded connection, and a third threaded connection;

wherein the second capped tube is the physical structure that encloses the open end of the equipment tube that is distal from the reservoir tube;

wherein the second threaded connection attaches the second capped tube to the equipment tube;

wherein the third threaded connection attaches the 90-degree elbow to the open end of the center capped tube;

wherein the third end is the end of the 90-degree elbow that attaches to the equipment tube;

wherein the fourth end is the end of the 90-degree elbow that is distal from the equipment tube.

11. The baseboard-cleaning implement according to claim 10 wherein the base is a disk-shaped structure;

wherein the base is a rigid structure;

wherein the cleaning surface attaches to the base to form a composite prism;

wherein the plurality of interchangeable brushes comprises a first brush, a second brush, and a third brush;

wherein the first brush comprises a plurality of bristles;

wherein the second brush comprises a microfiber textile sheeting;

wherein the third brush is an elastomeric polishing surface;

wherein by elastomeric polishing surface is meant a smooth surface formed from an elastomeric material.

12. The baseboard-cleaning implement according to claim 11 wherein the fastener comprises a tenon, a mortise, and a rotary union;

wherein the tenon is a prism-shaped structure that attaches to the closed end of the second capped tube;

wherein the base attaches the cleaning surface to the tenon of the fastener;

wherein the rotation of the tenon will rotate the individual brush attached to the handle;

wherein the tenon is a hollow structure such that the liquid soap pumped into the individual brush will flow through the tenon;

wherein the tenon inserts into the mortise;

wherein the mortise is a cavity that is formed in the base of the individual brush;

wherein the mortise is geometrically similar to the tenon;

wherein the span of the length of the perimeter of the mortise is greater than the span of the length of the perimeter of the tenon such that the tenon will insert into the mortise;

wherein the mortise aligns with the center axis of the base such that the rotation of the tenon will rotate the base around an axis of rotation aligned with the center axis of the base;

wherein the tenon secures itself to the mortise such that the rotation of the tenon has a load transfer path that allows for the rotation base of the individual brush;

wherein the rotary union is a bearing structure;

wherein the tenon attaches to the rotary union such that the rotation of the tenon by the electric motor is isolated from the second capped tube of the 90-degree elbow of the handle;

wherein the rotary union further provides a fluid path for the liquid soap to pass into the tenon for transport to the cleaning surface of the individual brush.

13. The baseboard-cleaning implement according to claim 12 wherein the battery is an electrochemical device;

wherein the master switch is a single throw single pole electrical switch;

wherein the master switch controls the flow of electricity from the battery into the DPDT switch;

wherein the DPDT switch is a double pole double throw electric switch;

wherein the polarity of the voltage placed across the electric motor is controlled by the DPDT switch;

wherein the DPDT switch provides electrical power to the pump;

wherein the tenon attaches to the electric motor of the control circuit such that the electric motor will rotate the tenon.

14. The baseboard-cleaning implement according to claim 13 wherein the first threaded connection attaches the first end of the center capped tube to the first capped tube;

wherein the second threaded connection attaches the fourth end of the 90-degree elbow to the second capped tube;

wherein the third threaded connection attaches the third end of the 90-degree elbow to the second end of the center capped tube;

wherein the positive terminal of the battery electrically connects to the first lead of the master switch;

wherein the second lead of the master switch electrically connects to the third lead of the DPDT switch;

wherein the fourth lead of the DPDT switch electrically connects to the ninth lead of the electric motor;

wherein the fourth lead of the DPDT switch electrically connects to the eighth lead of the DPDT switch;

wherein the fifth lead of the DPDT switch electrically connects to the tenth lead of the electric motor;

wherein the fifth lead of the DPDT switch electrically connects to the seventh lead of the DPDT switch;

wherein the seventh lead of the DPDT switch electrically connects to the tenth lead of the electric motor;

wherein the eighth lead of the DPDT switch electrically connects to the ninth lead of the electric motor;

wherein the sixth lead of the DPDT switch electrically connects to the negative terminal of the battery.

15. The baseboard-cleaning implement according to claim 14 wherein the reservoir tube further comprises a lid;

wherein the lid is a mechanical structure that encloses the open end of the reservoir tube;

wherein the lid further comprises a first capped tube and a first threaded connection;

wherein the first capped tube is the physical structure that encloses the open end of the reservoir tube;

wherein the first threaded connection attaches the first capped tube to the reservoir tube.

16. The baseboard-cleaning implement according to claim 15 wherein the cleaning surface is selected from the group consisting of a plurality of bristles, a microfiber head, and a polishing head.

* * * * *